United States Patent [19]

Thomas

[11] 4,304,323

[45] Dec. 8, 1981

[54] SECURITY HANGER

[76] Inventor: James E. Thomas, 1516 Sierra Dr. N.E., Cedar Rapids, Iowa 52402

[21] Appl. No.: 111,896

[22] Filed: Jan. 14, 1980

[51] Int. Cl.[3] ..... G07F 17/10
[52] U.S. Cl. ..... 194/64
[58] Field of Search ..... 194/64, 49, 63, 40

[56] References Cited

U.S. PATENT DOCUMENTS 3,197,008 7/1965 Moore ..... 194/64
3,917,047 11/1975 Cawthorne et al. ..... 194/49 X

*Primary Examiner*—Stanley H. Tollberg

*Attorney, Agent, or Firm*—Gabriel P. Katona; Haven E. Simmons

[57] ABSTRACT

A lockable, coin-operated coat hanger for temporarily securing a coat or other similar garment on a coat rack to discourage theft of the garment. The security hanger has a closed loop that fits over the rack bar and is secured to a housing. Arms for suporting the coat extend from the housing, and a chain with a shackle at its free end are affixed to one of the supporting arms. By inserting a coin which permits a key to be turned and removed, the shackle is freed and can be inserted through the sleeve of the garment and then pushed into a locking hole that secures the garment. The hanger can be unlocked and the garment removed only by reinserting the key to release the locking shackle.

8 Claims, 10 Drawing Figures

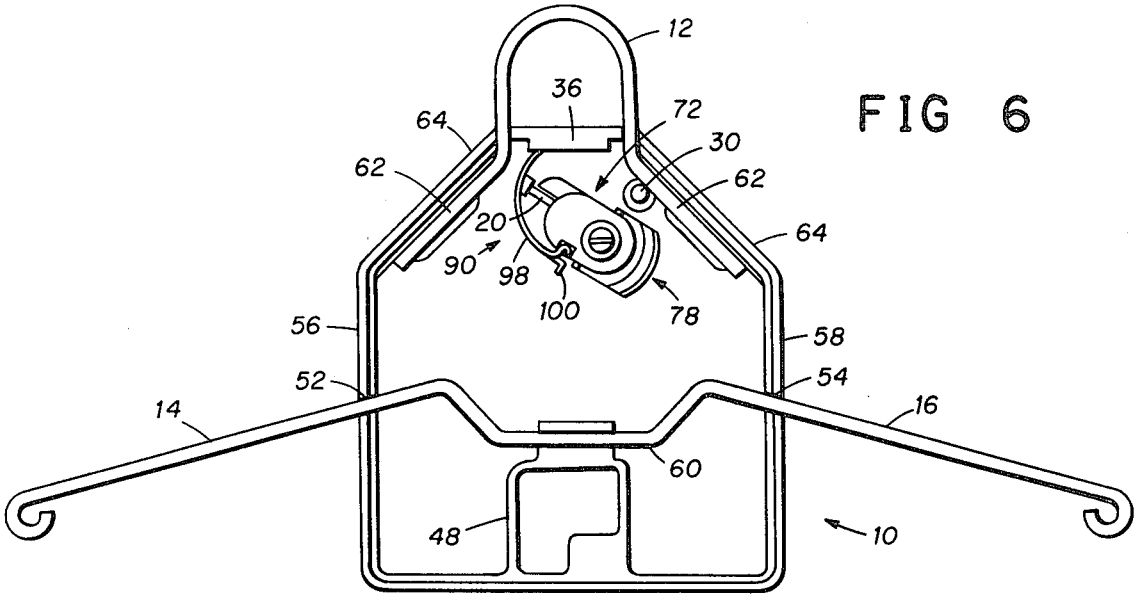
FIG 6
FIG 7
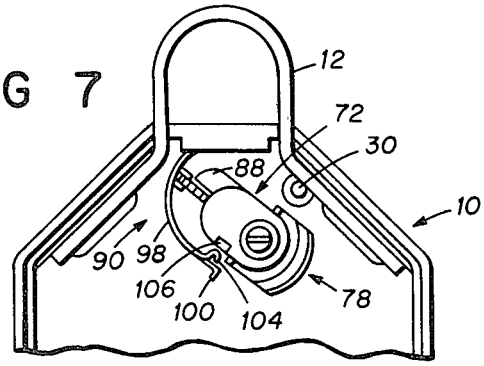
FIG 8
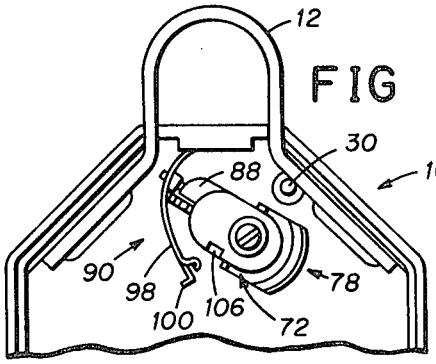
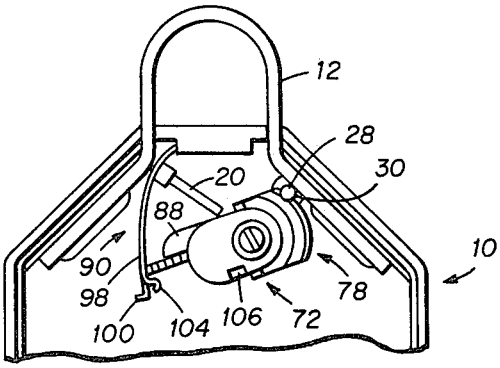
FIG 9
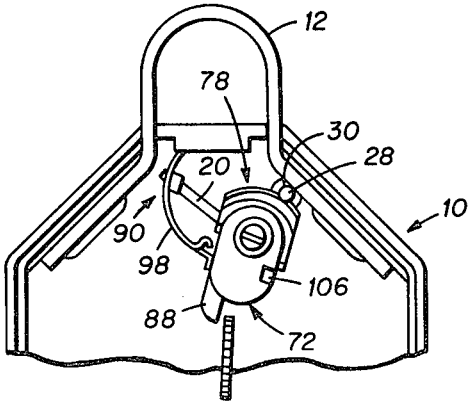
FIG 10

SECURITY HANGER

BACKGROUND OF THE INVENTION

The theft of coats and other similar garments placed by customers in an unattended coat room in a public or semi-public place continues to be a problem. In addition to theft of coats, almost everyone has experienced the loss of a coat by an innocent act of one who inadvertently takes the wrong coat. When such theft of mix-up occurs, customers of a business establishment frequently blame the owner or manager of the establishment. In order to minimize theft and mix-up and to keep the customers happy, many business establishments provide attendants who will check and watch over a customer's coat. However, hiring of an attendant adds to the cost of operating a business, especially where customers may come and go almost twenty-four hours a day, seven days a week. Also, small business establishments may find the cost of hiring an attendant prohibitive. Even where attendants can be cost justified, service can be slow in business establishments where all of the customers arrive at the establishment within a short period of time and leave practically all at once. This occurs in such establishments as theatres, civic centers, and other places where large crowds are attracted to a particular show or event.

The prior art does disclose a number of security hangers which have a chain or other flexible member that can be inserted through the sleeve of the garment with the free end of the chain then locked in place. Some of these prior art devices use padlock-type locking devices or permit the user to bring his or her own locking device. Others have parts that are separable. None of the prior art devices of which I have knowledge employ a coin-operated locking security hanger that is suitable for use in a business establishment, convenient to use and one that will produce income for the owner of the establishment. There is, therefore, a need for a commercial, lockable, coin-operated security hanger that will discourage theft and mix-up while producing profits for the owner of the establishment that employs such security hangers for the benefit of its customers.

SUMMARY OF THE INVENTION

The invention provides a commercially useable security coat hanger that has a coin-operated locking mechanism which permits the hanger to be used without attendants. Each security hanger has its own key that is removable only when a coin is inserted into a housing that forms a part of the hanger. Insertion of the coin permits the key to be removed and also allows a locking shackle attached to the end of a chain to be inserted through the arm of the garment and locked in a locking hole in the housing. The only way that the locking shackle can be removed is to reinsert the key and unlock the device. Thus, the security hanger is user-operated and eliminates the need for attendants. It also produces income sufficient to pay for itself and ultimately earn profits for the owner of the establishment where the hangers are used. The security hanger of the invention is extremely simple, has a minimum number of moving parts and is, therefore, substantially maintenance free and foolproof. It employs a special locking cam mechanism and two leaf-type springs. The invention thus provides a very effective security hanger for deterring theft, and the security hanger of the invention is extremely simple and keeps the cost of the hanger to a minimum. The invention thus provides an improved lockable coin-operated security hanger for coats and other similar garments.

BRIEF DESCRIPTION OF THE DRAWINGS

FIG. 6 is a rear elevational view showing the coin-operated locking mechanism in position to receive a coin;

FIG. 7 is a rear elevational view of the coin-operated locking mechanism showing a coin in position as it is first inserted into the coin slot in the front of the housing;

FIG. 8 is a rear elevational view similar to FIG. 7 and showing the coin camming the coin acceptance spring as the key is turned;

FIG. 9 is a rear elevational view similar to FIGS. 7 and 8 but showing the coin just before it drops into place in the housing; and FIG. 10 is a rear elevational view similar to FIGS. 7, 8 and 9 and showing the coin released from the locking mechanism with the locking mechanism in a locked position.

DESCRIPTION OF THE PREFERRED EMBODIMENT OF THE INVENTION

Figure 1:
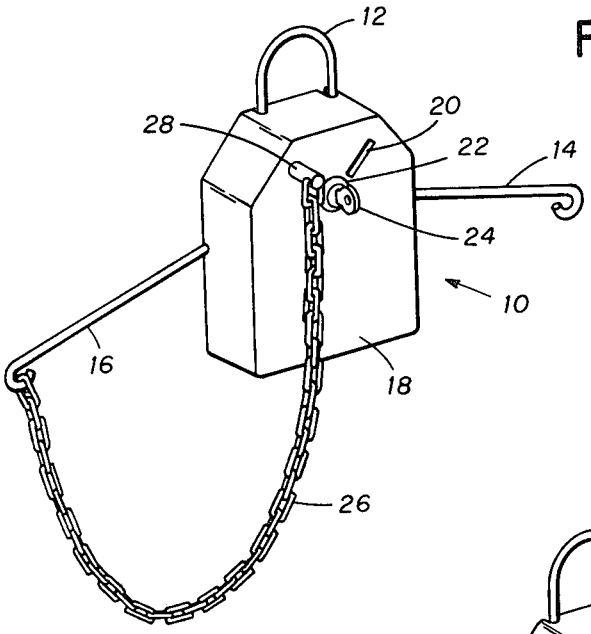
FIG. 1 is a perspective view of a security hanger constructed according to the principles of the invention and showing the device when not in use.

Referring first to FIG. 1, there is shown a security hanger constructed according to the principles of the invention, which security hanger includes a housing 10 from the top of which extends a closed loop hanger 12 and from the sides of which housing 10 extend arms 14 and 16. The front wall 18 of housing 10 includes a slot 20 sized to receive a coin, such as a quarter, and a lock, indicated generally by the reference numeral 22, into which there is inserted a key 24. The lock 22 is a standard, commercially available quarter-turn cam lock.

At the outer end of arm 16 there is affixed a chain 26 or other flexible member preferably constructed of a durable, hard material that is difficult to break or cut. At the free end of chain 26 there is secured a locking shackle 28 that fits into locking hole 30 in the front of housing 10 which hole 30 is best seen in FIGS. 6–10, inclusive. Locking shackle 28 has a tapered, cone-shaped outer end behind which is formed an annular locking groove 29.

Figure 2:
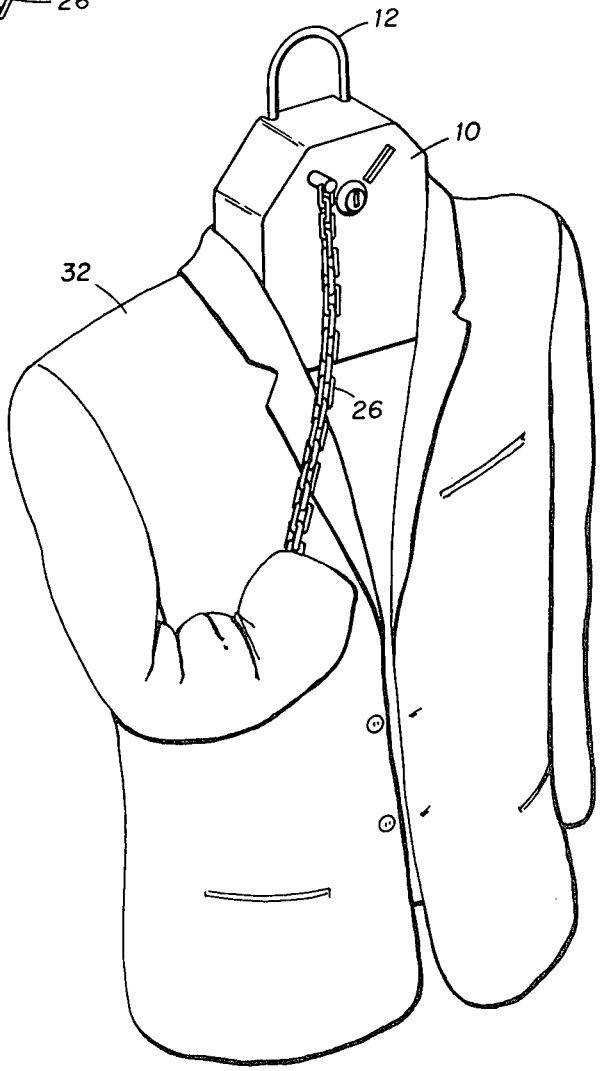
FIG. 2 is a perspective view similar to FIG. 1 but showing the device in use with a garment in place and supported on the security hanger.

As shown in FIG. 2, the arms 14 and 16 provide support for a garment 32, and when the garment is secured, chain 26 extends through a sleeve of the garment as shown, and the locking shackle 28 is locked in hole 30 in the manner described hereinafter.

Figure 3:
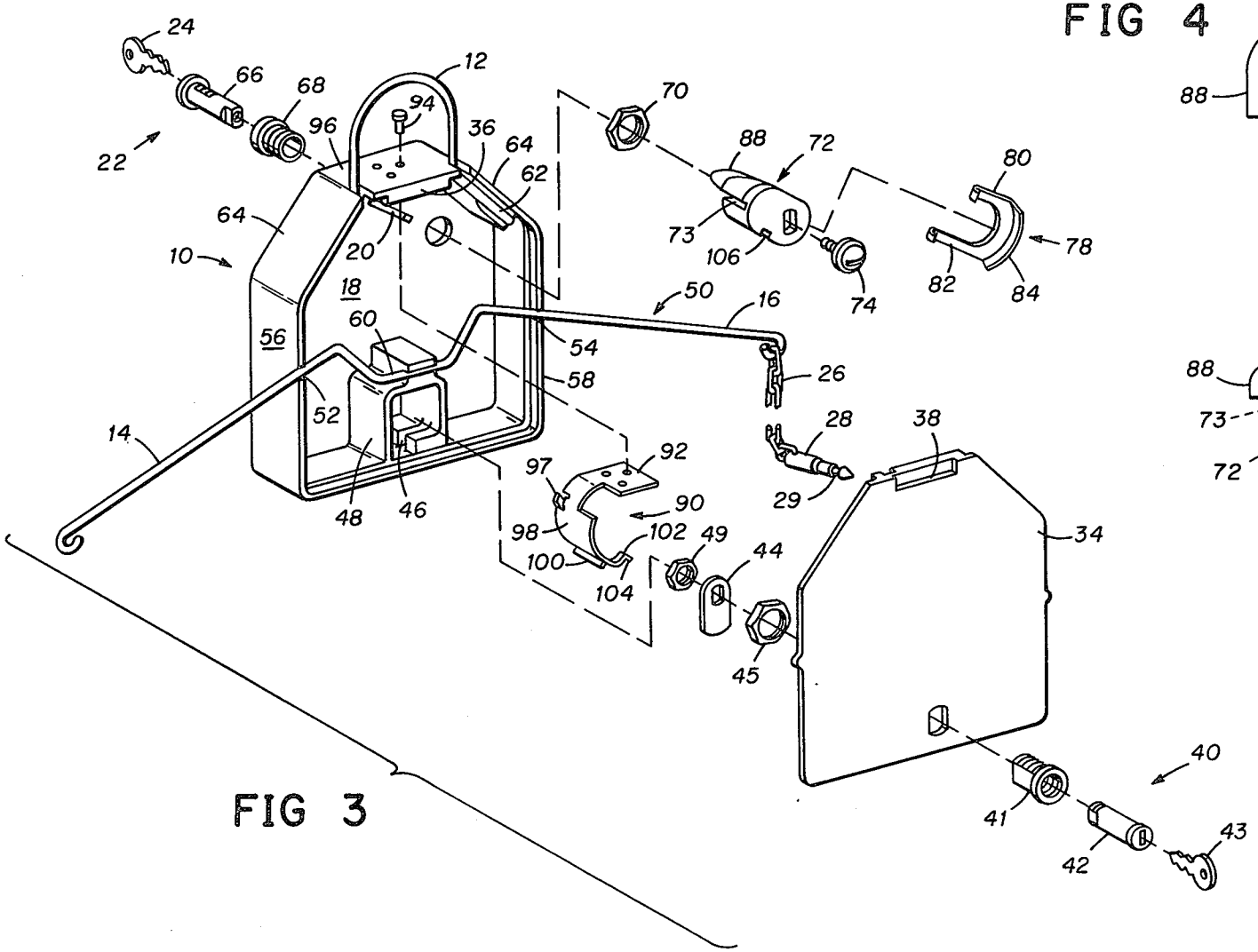
FIG. 3 is an exploded perspective view from the rear of the security hanger showing the operating components of the two locking mechanisms.

FIG. 3 shows an exploded view of all of the components of a security hanger constructed according to the principles of the invention, and the various components will now be described in detail. Housing 10 includes a removable back plate 34 that is normally locked in place by engagement of a lip 36 in housing 10 with a recess 38 formed in the top edge of the back plate 34. The back plate 34 also includes a standard, quarter-turn cam lock 40 of any suitable type that permits a cylinder 42 to be turned 90 degrees when the proper key 43 is inserted. Cylinder 42 is turnable in a threaded, shouldered sleeve 41 that is assembled to the back plate 34 by a suitable nut 45. The cylinder 42 has a locking arm 44 affixed to it by nut 49, and locking arm 44 is turnable with cylinder 42 so as to be engageable in a groove 46 formed near the bottom of housing 10. Preferably, an inner wall 48 encloses the locking mechanism 40 to prevent it from becoming jammed by coins dropping inside of the housing during use of the device.

As shown in FIG. 3, the arms 14 and 16 that support the garment are part of a continuous bar 50 that fits into grooves 52 and 54 formed in the side walls 56 and 58, respectively, of housing 10. The center portion 60 of bar 50 is received in a groove formed at the top of the inner wall 48. Thus, with back plate 34 locked in place, the bar 50 (and thus arms 14 and 16) are securely held in place.

Similarly, the closed loop hanger 12 is formed from a continuous member that has legs 62 seated in grooves formed inside of housing 10 along the sloping upper walls 64 of housing 10. Thus, the hanger 12 is removable by removing the back plate 34 and slipping hanger legs 62 out of their respective grooves. This permits the security hanging device to be installed over an existing rack bar which normally will not have a free end to permit a closed loop to be slipped over the rack bar.

A coin-operated locking mechanism includes the lock 22 which has a locking cylinder 66 received in a threaded sleeve 68 that is held in place in the front wall 18 of housing 10 by a suitable locking nut 70. A specially designed cam, indicated generally by the reference numeral 72, receives the end of locking cylinder 66 and is turnable with locking cylinder 66. The cam 72 and locking cylinder 66 are removably held in assembled condition by a fastening device such as threaded member 74.

Figure 4:
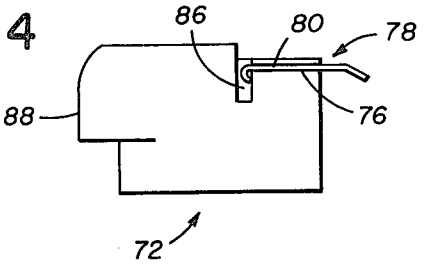
FIG. 4 is a side elevational view of the locking cam and locking spring.
Figure 5:
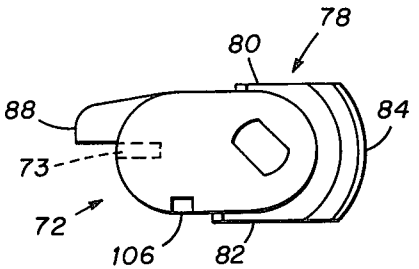
FIG. 5 is a top view of the locking cam and locking spring of FIG. 4.

The cam 72 has a circumferential groove 76 formed at one end to receive a horseshoe shaped locking spring 78. The locking spring 78 has a short leg 80 and a long leg 82, and the entire curved edge 84 of the closed end is formed downwardly (FIG. 4) out of the plane of the spring 78. As best seen in FIG. 3, the short leg 80 and the long leg 82 are also formed with a 180 degree bend or hook at their outer ends. Locking spring 78 is preferably formed of a spring steel and is assembled onto the cam 72 by sliding the spring into the groove 76 until the ends of the short and long legs 80 and 82 lock into place in an axial groove 86 and a similar groove on the opposite side (not shown).

At the end of cam 72 opposite the locking spring 78, there is formed a coin receiving slot 73 of sufficient size to receive the coin for which the device is designed. Cam 72 is also formed with a camming lug 88 that is engageable with a coin acceptance spring indicated generally by the reference numeral 90. Coin acceptance spring 90 is also constructed of spring steel and has an attaching leg 92 that is attached by rivets 94 to the top wall 96 of housing 10. The main body 98 of spring 90 is curved and it has a coin-retention lug 97 formed along the edge closest to the front wall 18. Its outer end is bifurcated to form a wide leg 100 and a narrow leg 102. The outermost end of leg 100 is curved in the opposite direction from main body 98 while the narrow leg 102 is formed in a somewhat S-shape to provide a locking hook 104 for a purpose to be described hereinafter.

When the locking mechanism is assembled, the camming lug 88 is aligned so as to be engageable with the wide leg 100 while the locking hook 104 of the narrow leg 102 is engageable with a locking recess 106 formed in the cam 72.

The use and operation of the coin-operated security hanger will now be described.

FIG. 1 shows the security hanging device in its normal condition when not in use. In this condition, the back plate 34 is in place and the lock 40 is locked so that the arm 44 is engaged in groove 46. The key 43 is removed, and the owner or operator of the establishment will, of course, retain the key 43 so that periodically the coins can be removed from the housing 10. When not in use, the lock 22 will be in an "unlocked" condition with the key 24 inserted in the locking cylinder 66. In this position, with the standard type of lock used, the key 24 cannot be removed. Also, the locking shackle 28 can be inserted and withdrawn from the locking hole 30. The coin-operated locking mechanism in the "unlocked" position is shown in FIG. 6, and any attempt to turn the key 24 is prevented by engagement of the locking hook 104 of spring 90 in the groove 106 of cam 72. The coin slot 73 of cam 72 is aligned with the coin slot 20 in the front wall 18, and the alignment is maintained by the locking hook 104 preventing the cam 72 from turning.

If a user desires to secure a garment on the security hanging device, the locking shackle 28 is removed from the locking hole 30. Then, the required coin is inserted through the slot 20 in the front wall 18 of housing 10. The coin will engage the coin-retention lug 97 of spring 90 and bias the spring 90 out of the way to permit the coin to enter the coin slot 73 formed in cam 72. After the coin enters the slot 73, it will become disengaged from lug 97, and when fully inserted into slot 73, the coin cannot be removed, being retained in the mechanism by slot 73 and coin retention lug 97. When fully inserted, the edge of the coin will engage the main body 98 of spring 90 forcing it away from the cam 72 and disengaging the locking end 104 from the locking recess 106 (FIG. 7). This permits the cam 72 and key 24 to be turned. When the key 24 is turned (clockwise FIG. 1 and counterclockwise FIGS. 6–10), the cam 72 will also be turned carrying with it the coin positioned in slot 73. As the key 24 continues to be turned by the user (FIGS. 8 and 9), the coin will slide along the inner surface of the main body 98 of spring 90 until it becomes disengaged from spring 90 at which time it will fall to the bottom of housing 10 (FIG. 10). At this time, the key 24 and cam 72 will have been fully rotated the limit of the lock 22, approximately 90 degrees.

Throughout rotation of the key 24 and cam 72, the locking spring 78 has also been rotated. As shown in FIGS. 6 and 7, when in the "unlocked" position, the locking hole 30 is unobstructed and the locking shackle 28 can be freely inserted and removed from the locking hole 30. However, when a coin is inserted through slot 20 into the slot 73 of cam 72 and the key 24 and cam 72 turned, the edge 84 of locking spring 78 will move across the locking hole 30 and partially obstruct it (FIG. 9). When the key 24 and cam 72 have completed the full 90 degree rotation from an "unlocked" to a "locked" position, the locking spring 78 will be in the position shown in FIG. 10. At this point, the key 24 can be removed from the locking cylinder 66, and the user will then slip the chain 26 through the sleeve of the garment and push the locking shackle 28 firmly into the locking hole 30. The edge 84 of locking spring 78 will be engaged by the cone-shaped end of locking shackle 28 and cammed away to permit the locking shackle to enter the locking hole 30. However, the annular locking groove 29 formed near the end of locking shackle 28 will then be engaged by the edge 84 of locking spring 78 and prevent the locking shackle 28 from being withdrawn. The garment is now secured.

To remove the garment from the security hanging device, it is necessary to insert key 24 into lock 22 and turn the key 90 degrees counterclockwise (FIG. 1 or clockwise FIGS. 6–10). As the key 24 is turned to the "unlocked" position, the camming lug 88 will engage the wide leg 100 of spring 90 and then engage the main body 98 until the locking hook 104 re-engages the locking recess 106 in cam 72. As the cam 72 is turned from the "locked" to the "unlocked" position, locking spring 78 will move away from locking hole 30, thus releasing the locking shackle 28 and allowing the garment to be removed from the hanger. At this time, the coin slot 73 of cam 72 will again be in alignment with the coin slot 20 in the front wall 18 of the housing 10. In this "unlocked" position, the key 26 cannot be removed from the lock 22 nor can the key be turned until another coin is inserted into slot 20.

From the foregoing description, it will be evident that the security hanger device of the invention is an extremely simple but yet substantially foolproof device for securing a garment. The device consists of very few moving parts, and the use of the locking spring 78 and the coin acceptance spring 90 eliminate the necessity for numerous components. Also, the design of the mechanism using the two springs 78 and 90 together with the cam 72 provide a device that is literally jam-proof. Because of its simplicity, the device can be produced in quantities at a relatively low cost thus making it attractive to the owners of business establishments since the device will quickly pay for itself and thereafter produce profit. Also, because of its simplicity, the device is virtually maintenance free.

Having thus described the invention in connection with the preferred embodiment thereof, it will be evident to those skilled in the art that various revisions and modifications can be made to the preferred embodiment without departing from the spirit and scope of the invention. It is my intention, however, that all such revisions, modifications and variations as are obvious to those skilled in the art will be included within the scope of the following claims.

I claim:

1. A coin-operated security hanger for having a coat or the like on a hanging rack or bar, said security hanger comprising a housing having a plurality of walls defining an enclosed chamber, means associated with at least one of said walls to provide for access to the chamber, a flexible elongated member having a free end insertable through an opening of the coat to be hung and having its other end secured to the security hanger, a locking member secured to the free end of said flexible member, one of said walls having an opening to receive said locking member, means combined with said housing to provide for securing said hanger to the hanging rack, arms combined with said housing and extending therefrom to provide for support of a coat hung thereon, a coin-operated lock combined with said housing and having a keyhole in a wall of said housing for receiving a key to operate said lock, the key being removable only when said lock is in a locked condition, one of said walls having a slot to allow a coin of predetermined size to be inserted into the chamber, the coin-operated lock including first locking means in said chamber to prevent operation of said lock from an unlocked condition to a locked condition unless a coin is inserted in said slot to actuate said means, and second locking means included in said coin-operated lock to prevent withdraw of said locking member when said locking member is inserted in said opening and said lock is in a locked condition.

2. The coin-operated security hanger of claim 1 in which the coin slot is located adjacent to the keyhole.

3. The coin-operated security hanger of claim 2 in which the first locking means includes a resilient member in said chamber that is normally biased to prevent operation of the lock from an unlocked to a locked condition, said resilient member being positioned so as to be engaged by a coin inserted through the slot, and when said coin is fully inserted said resilient member will be moved by the coin to allow the lock to be operated.

4. The coin-operated security hanger of claim 3 in which said resilient member has a locking portion, and said lock has a groove normally engageable by said locking portion to prevent said lock from being operated by turning the key.

5. A coin-operated security hanger for hanging a coat or the like on a hanging rack or bar, said security hanger comprising a housing having a plurality of walls defining an enclosed chamber, means associated with at least one of said walls to provide for access to the chamber, a flexible elongated member having a free end insertable through an opening of the coat to be hung and having its other end secured to the security hanger, a locking member secured to the free end of said flexible member, one of said walls having an opening to receive said locking member, means combined with said housing to provide for securing said hanger to the hanging rack, arms combined with said housing and extending therefrom to provide for support of a coat hung thereon, a coin-operated lock combined with said housing and having a keyhole in a wall of said housing for receiving a key to operate said lock, the key being removable only when said lock is in a locked condition, one of said walls having a slot to allow a coin of predetermined size to be inserted into the chamber, the coin-operated lock including first locking means in said chamber to prevent operation of said lock from an unlocked condition to a locked condition unless a coin is inserted in said slot to actuate said means, and second locking means included in said coin-operated lock to prevent withdraw of said locking member when said locking member is inserted in said opening and said lock is in a locked condition, said second locking means including a second resilient member movable across the opening that receives the locking member as the lock is operated from the unlocked condition to the locked condition, said resilient member being engageable with said locking member when the lock is in the locked condition to prevent withdraw of said locking member after it is inserted in said opening.

6. The coin-operated security hanger of claim 5 in which the second resilient member is a relatively thin member of spring steel that is movable across at least a portion of said opening as said lock is operated from an unlocked to a locked condition by turning the key, and the end of said locking member is tapered and has a locking groove formed near the tapered end which groove is engaged by said resilient member as the locking member is inserted in the opening thereby preventing withdrawal of the locking member once it is inserted into said opening with the lock in a locked condition.

7. The coin-operated security hanger of claims 1, 2, 3, 4, 5 or 6 in which at least a portion of one of the walls of the housing is removable to provide access to said chamber, and a lock is combined with the removable wall and the housing to provide for access to the chamber only when the lock on said removable wall is unlocked.

8. The coin-operated security hanger of claims 1, 2, 3, 4, 5 or 6 in which at least a portion of one of the walls of the housing is removable to provide access to said chamber, and a lock is combined with the removable wall and the housing to provide for access to the chamber only when the lock on the removable wall is unlocked, and the means that provides for securing said hanger to the hanging rack is a one-piece open looped member detachable from said housing when said removable wall is removed, said open looped member being closed when assembled and combined with the housing to prevent the security hanger from being removed from a closed-end hanging bar when said hanger is assembled and the removable wall locked in place.

* * * * *